US012553301B1

(12) United States Patent
Kykkanen et al.

(10) Patent No.: US 12,553,301 B1
(45) Date of Patent: Feb. 17, 2026

(54) TUBING ANCHOR WITH LOCKING LUG RING

(71) Applicant: Silver Fox Completion Services, Inc, Red Deer County (CA)

(72) Inventors: Kelly Kykkanen, Okotoks (CA); Anthony Honke, Red Deer County (CA); Graham Chenault, Argyle, TX (US); Brad Long, Jarvis Bay (CA); Tanner Ingram-Johnson, Red Deer County (CA)

(73) Assignee: Silver Fox Completion Services, Inc, Red Deer County (CA)

( * ) Notice: Subject to any disclaimer, the term of this patent is extended or adjusted under 35 U.S.C. 154(b) by 0 days.

(21) Appl. No.: 19/237,563

(22) Filed: Jun. 13, 2025

Related U.S. Application Data

(60) Provisional application No. 63/721,155, filed on Nov. 15, 2024.

(51) Int. Cl.
*E21B 23/01* (2006.01)

(52) U.S. Cl.
CPC ..... *E21B 23/01* (2013.01)

(58) Field of Classification Search
CPC ..... E21B 23/01
See application file for complete search history.

(56) References Cited

U.S. PATENT DOCUMENTS 1,608,167 A * 11/1926 Crowell ..... E21B 23/01 166/209
1,866,087 A * 7/1932 Crowell ..... E21B 40/001 166/210
2,380,612 A * 7/1945 Quintrell ..... E21B 23/01 166/240
3,026,941 A * 3/1962 Muse ..... E21B 33/1292 166/134
3,058,526 A * 10/1962 Douglass ..... E21B 40/001 166/216
3,191,684 A * 6/1965 Pittman ..... E21B 23/01 166/216
3,467,184 A * 9/1969 Young ..... E21B 33/1294 166/182
3,664,417 A * 5/1972 Conrad ..... E21B 23/01 166/216
4,131,160 A * 12/1978 Cochran ..... E21B 23/06 166/182

(Continued)

*Primary Examiner* — Steven A Macdonald
(74) *Attorney, Agent, or Firm* — Henry Patent Law Firm PLLC

(57) ABSTRACT

In a general aspect, a tubing anchor and methods of operation are described. In some examples, a tubing anchor includes a tubular conduit that has a mating component. The tubing anchor also includes a gripping assembly; tapered members; a compression spring; a friction assembly; and a guide body comprising a receptacle track. The tubing anchor also includes a lug ring around the tubular conduit. The lug ring can rotate with rotation of the tubular conduit, and the lug ring has an outward protruding lug that can move within the receptacle track between a set position and an unset position. The tubing anchor also includes a lock member connected to the lug ring. The lock member can engage the mating component of the tubular conduit to prevent the lug ring from returning to the set position when the lug ring has been sheared from the tubular conduit.

18 Claims, 7 Drawing Sheets

(56) References Cited

U.S. PATENT DOCUMENTS 4,156,460 A * 5/1979 Crowe ..... E21B 33/1293 166/134
4,732,212 A * 3/1988 Fraser, III ..... E21B 23/01 166/216
4,750,559 A * 6/1988 Greenlee ..... E21B 23/01 166/216
4,750,563 A * 6/1988 Baugh ..... E21B 23/01 166/216
4,762,177 A * 8/1988 Smith, Jr. ..... E21B 23/01 166/216
5,667,016 A * 9/1997 Henderson ..... E21B 33/129 166/123
5,771,969 A * 6/1998 Garay ..... E21B 31/20 166/214
8,991,485 B2 * 3/2015 Chenault ..... E21B 33/1292 166/134
9,016,364 B2 * 4/2015 Chenault ..... E21B 33/1292 166/387
9,816,347 B2 * 11/2017 Chenault ..... E21B 33/1292
9,890,603 B2 2/2018 Moore et al.
10,450,816 B2 * 10/2019 Bringham ..... E21B 23/01
10,920,510 B2 * 2/2021 Egleton ..... E21B 23/0411
11,649,687 B1 * 5/2023 Dawson ..... E21B 17/1078 166/206
12,031,411 B1 7/2024 Clark et al.
12,152,451 B2 11/2024 Stachowiak, Jr. et al.
2006/0272828 A1 * 12/2006 Manson ..... E21B 33/129 166/138
2008/0023195 A1 * 1/2008 Johnson ..... E21B 23/01 166/208
2010/0230116 A1 * 9/2010 Harmon ..... E21B 23/06 166/382
2012/0125637 A1 * 5/2012 Chenault ..... E21B 33/1294 166/382
2012/0125642 A1 * 5/2012 Chenault ..... E21B 33/1292 166/387
2014/0305633 A1 * 10/2014 Bracken ..... E21B 23/004 166/242.3
2015/0176366 A1 * 6/2015 Chenault ..... E21B 33/1292 166/133
2015/0233199 A1 * 8/2015 Moore ..... E21B 23/01 166/209
2015/0259998 A1 * 9/2015 Moore ..... E21B 40/001 166/382
2015/0322740 A1 * 11/2015 Marshala ..... E21B 23/006 166/217
2016/0312569 A1 * 10/2016 Hanson ..... E21B 23/06
2017/0225106 A1 * 8/2017 Gurnicz ..... B01D 41/04
2017/0234090 A1 8/2017 Egleton et al.
2017/0350204 A1 * 12/2017 Moore ..... E21B 17/023
2020/0240233 A1 * 7/2020 Chenault ..... E21B 23/06
2020/0325750 A1 * 10/2020 Zachry ..... E21B 33/1293
2023/0399903 A1 * 12/2023 Stachowiak, Jr. .... E21B 23/006
2024/0384629 A1 * 11/2024 Themig ..... E21B 23/01

* cited by examiner

TUBING ANCHOR WITH LOCKING LUG RING

CROSS-REFERENCE TO RELATED APPLICATIONS

This application claims priority to U.S. Provisional App. No. 63/721,155, filed Nov. 15, 2024, entitled "Tubing Anchor with Locking Lug Ring", the entire content of which is hereby incorporated by reference.

BACKGROUND

The following description relates to tools for cased wellbores, and more particularly, tubing anchors (also referred to as tubing anchor catchers) for supporting a tubing string in a cased wellbore.

A tubing string, often referred to as a production string, serves as the conduit for producing oil and gas from the underground reservoirs to the surface and for positioning downhole tools within the wellbore. The tubing string comprises interconnected sections of individual pipe joints, typically threaded together. This tubing string extends within the bore of the well (also referred to as the wellbore), which is usually completed with casing or liners, also known as a well conduit. The tubing string plays a crucial role in transporting various downhole tools into the well conduit. These tools serve diverse functions, such as manipulating the flow of the hydrocarbons to the surface or anchoring the tubing string within the wellbore to control movement effectively.

DETAILED DESCRIPTION

Figure 1:
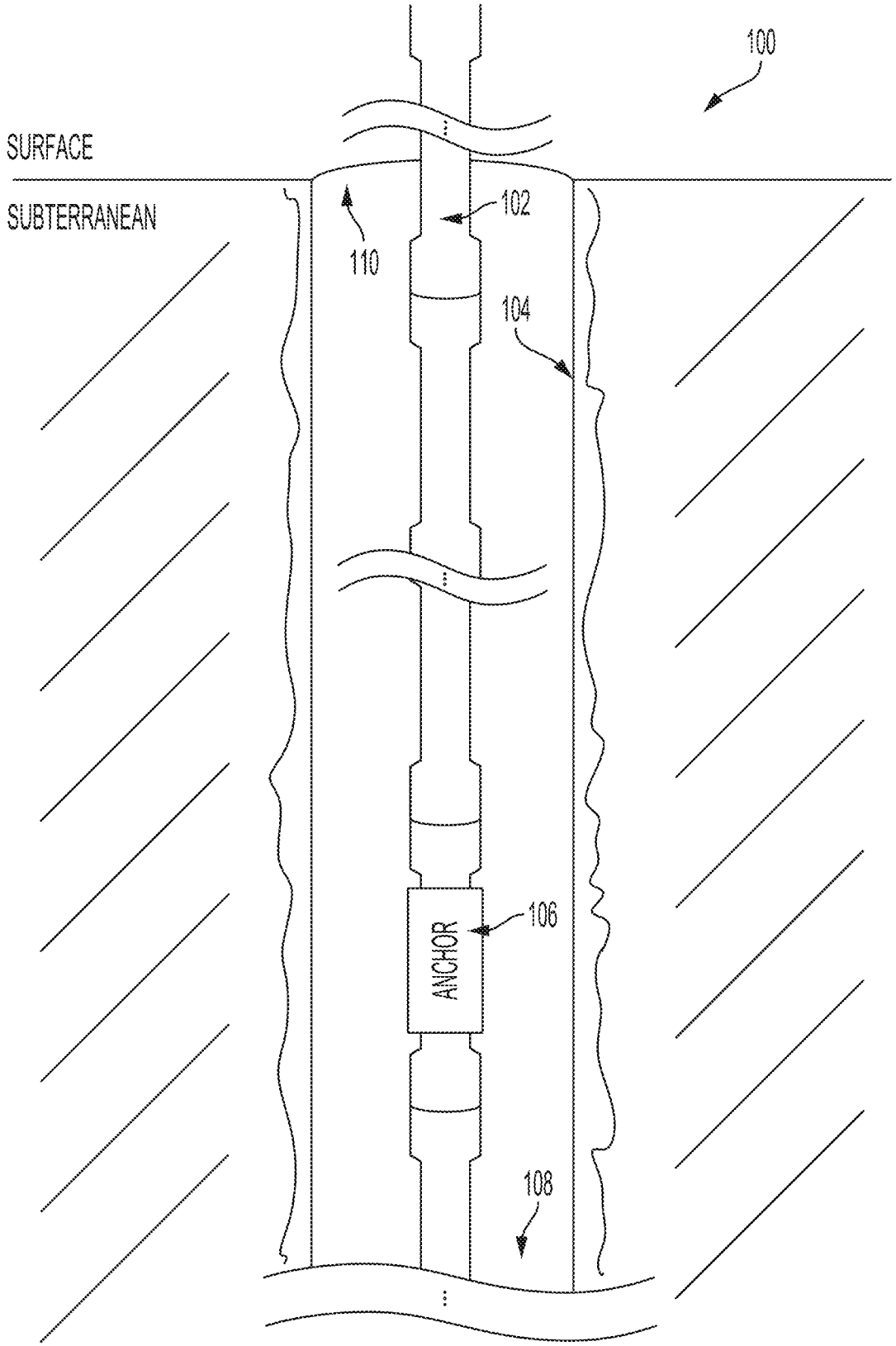
FIG. 1 is a schematic diagram of an example tubing string in a wellbore for extracting hydrocarbon fluid from a target reservoir formation.

In some aspects of what is described here, a tubing anchor restricts movement of a tubing string in a cased wellbore. In some implementations, the tubing anchor includes a tubular conduit having a mating component, a gripping assembly around the tubular conduit, and two tapered members around the tubular conduit. The gripping assembly includes a gripping member that can extend outward from the tubing anchor to engage an inner wall of wellbore casing. In some implementations, the tubing anchor includes a compression spring around the tubular conduit; when compressed, the compression spring can move one of the tapered members toward the other to cause the gripping member to extend outward. In some implementations, the tubing anchor includes a friction assembly around the tubular conduit. The friction assembly includes a friction member that can engage the inner wall of the wellbore casing. In some implementations, the tubing anchor includes a guide body around the tubular conduit. The guide body includes a receptacle track. In some implementations, the tubing anchor also includes a lug ring around the tubular conduit. The lug ring can rotate with rotation of the tubular conduit, and the lug ring includes an outward protruding lug that can move within the receptacle track of the guide body between a set position and an unset position. In some implementations, the tubing anchor includes a lock member that resides around the tubular conduit and is connected to the lug ring. The lock member can engage the mating component of the tubular conduit to prevent the lug ring from returning to the set position when the lug ring has been sheared from the tubular conduit.

In some implementations, the tubing anchor is disposed downhole into the wellbore during operations associated with extracting hydrocarbon fluid from a target reservoir formation. Such operations may include producing a flow of hydrocarbon fluid out of the target reservoir formation via the wellbore. Other types of operations, however, are also possible.

Tubing anchors are employed to restrict tubing movement in both directions. In some instances, a tubing anchor can include features that allow an operator to confirm that a tubing string remains intact, for example, after applying a force to the tubing string. For instance, applying force to the tubing string in an effort to shear a lug ring may result in movement of the tubing string but fail to shear the lug ring of the tubing anchor (e.g., another component in the tubing string could have sheared or failed). Therefore, after applying force to the tubing string with the intention of shearing the lug ring (and, consequently, unsetting of the tubing anchor), an operator needs confirmation that the lug ring actually sheared even if the tubing string is able to be pulled uphole.

The ability to move the tubing string further downhole after applying the shearing force can provide the operator with an indication that the tubing string is still intact. For example, application of the shearing force could have caused separation of the tubing string above the tubing anchor that remains in a set state, instead of causing the tubing anchor to shear and unset. In such examples, moving of the tubing string downhole after applying the force would cause the freed portion of the tubing string to be impeded from moving further downhole by the portion that is still anchored. A tubing anchor that enables an operator to go below the initial setting depth after applying a shearing force (to unset the tubing anchor by shearing the lug ring) can provide improved operational information and advantages. For example, an operator that is confident that the lug ring has sheared and the tubing string is intact may not need to pull the entire string from the hole to verify and/or may continue to run the tubing string further down hole without pulling the entire string out.

In some implementations, tubing anchors can be inserted into the well using a conventional tubing string and can be deployed at any depth. The slips (gripping members) can be designed to hold and anchor in tension, neutral or compression. In some examples, a guide body that includes a J-slot design can allow for easy setting and releasing with rotation (e.g., a quarter turn) at the anchor. In some examples, such anchors can be designed with a field adjustable shear/lug ring for a straight pull emergency release. The lug ring, in conjunction with the internal lock ring, allows this anchor to be locked away allowing for the anchor to be lowered back downhole if required. This design feature allows the user to verify that the anchor has been released correctly. This design combination of the lug/lock ring can lock away the two parts away from the tool. In some instances, this prevents the slips from contacting any of the cones and restricting the downward movement. In some examples, the lug and lock ring are also able to be used multiple times before replacing (e.g., not a one-use design). The design pattern of the shear screw holes can ensure an even stress application across the lug ring as there is not any concentrated area where the shear screws are installed that can cause premature failure due to stress loading.

In some examples, setting a tubing anchor can include rotation of the tubing at a desired depth. For instance, a quarter-turn rotation to the right may be performed to set a tubing anchor; or the tubing anchor may be designed to utilize a different rotation. Drag blocks can create friction against the casing wall, allowing the top sub, mandrel, and lug ring to follow the rotation of the tubing string. In some examples the rotation follows the J-slot design in the guide body. Upon initial compression, the lug ring shifts into the set position within the guide body. While the drag block body and lower cone remain stationary, lowering the tubing string causes the slip contained in the slip cage to make contact with the lower cone first. Subsequently, this contact transfers the slip to the upper cone, compressing the spring against the lower edge of the top sub. This sequence enables the anchor to support the weight (compression) of the tubing string. To ensure proper slip penetration into the casing wall, the tubing string undergoes cycles of tension, compression, and tension again. The tool can be engineered to leave the tubing string in a state of tension, compression, or neutral position.

In some examples, a tubing anchor can also be unset using a rotation (e.g., a quarter-turn rotation). The tubing string is lowered into a compressed state at the designated setting depth, enabling the lug ring to undergo a quarter-turn right-hand rotation (applied torque). This rotation, facilitated through the top sub, mandrel, and lug ring, allows the lug ring to ascend through the guide body and return to its initial run-in position within the well. Applying tension subsequently releases the slips from the casing by initially displacing the upper cone from beneath the slips. As the spring uncompresses, the lower cone disengages from the slip, restoring all components to their original run-in position within the well. At this point, the tool can be safely extracted from the wellbore. If the quarter-turn rotation to unset the tubing anchor does not work, the straight pull emergency release can be used.

FIG. 1 is a schematic diagram of an example tubing string in a wellbore for extracting hydrocarbon fluid from a target reservoir formation. The diagram of FIG. 1 is illustrative and does not necessarily represent the scale and detail of possible implementations. FIG. 1 illustrates a cross-section of wellbore 100 that has been drilled from the surface through subterranean formations in order to, for example, access a target such as a reservoir formation that holds hydrocarbons. In this example, wellbore 100 is stabilized with casing 104 along a portion of its length. Wellbore 100 can be a vertical well, horizontal well, or a well having a combination of both vertical and horizonal portions. As shown in FIG. 1, tubing string 102 is present in wellbore 100. Tubing string 102 includes segments of tubing (e.g., tubular conduit) and/or tools. A tubing anchor is an example tool. As illustrated in FIG. 1, tubing string 102 includes tubing anchor 106, which is a tubing anchor that includes one or more of the features described herein such as those described with respect to FIG. 2, 3, or 4A-4C. In FIG. 1, wellbore 100 includes an uphole direction 110 toward the surface opening of the wellbore (e.g., toward a rig, wellhead, or production platform at the surface) and a downhole direction 108 away from the surface. In some instances, tubing anchor 106 can be lowered into wellbore 100 (or raised within wellbore 100) as part of moving tool string 102. At a desired setting depth, an operator can perform a setting action that causes tubing anchor 106 to change from an unset state (e.g., that allows tubing string 102 to move up or down through wellbore 100, also referred to as longitudinal or vertical movement) to a set state (e.g., that limits tubing string 102 from moving up or down through wellbore 100). While tubing anchor 106 is set, an operator can perform an unsetting action to unset tubing anchor 106 so that tubing string 102 can be moved. Additional description of the operation of the tubing anchor is described with respect to FIGS. 2, 3, and 4A-4C.

Figure 2:
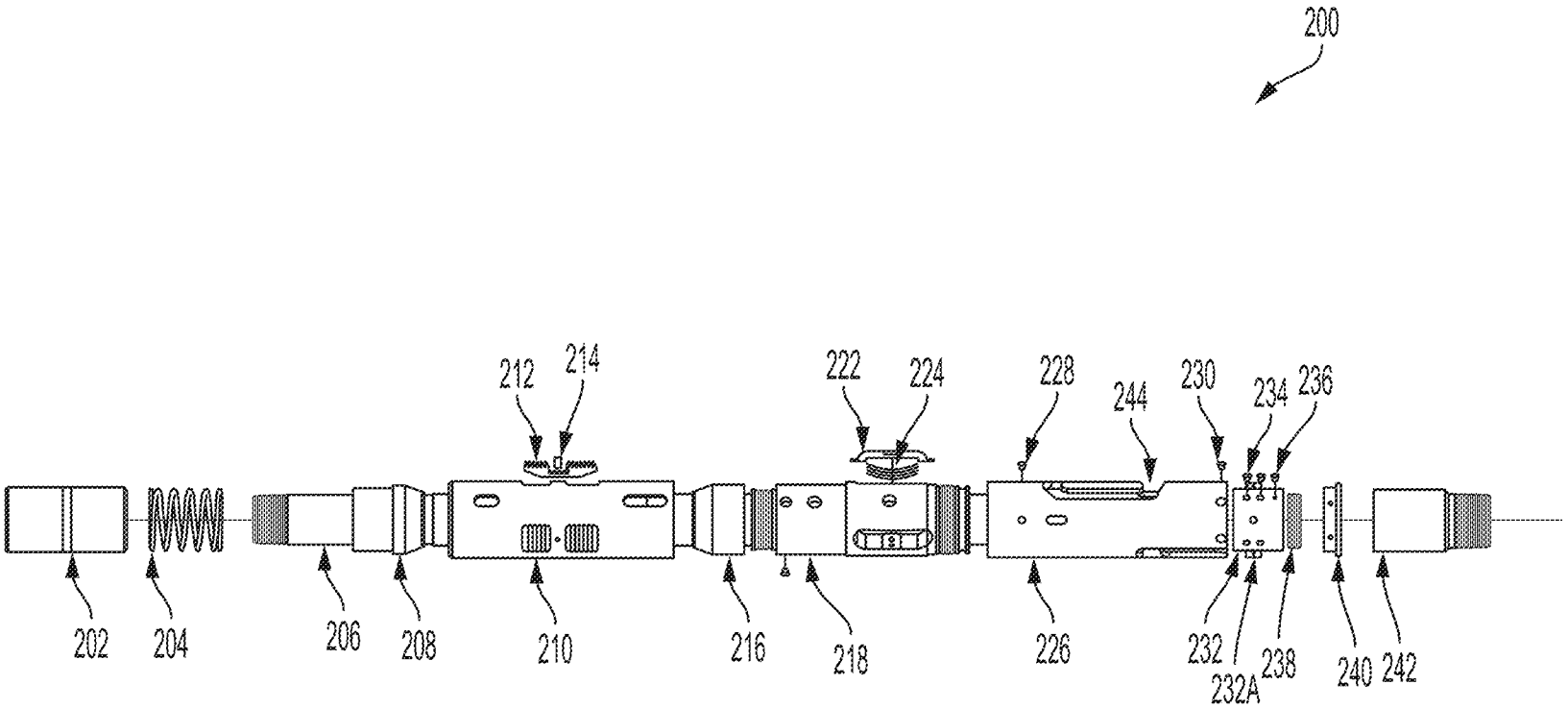
FIG. 2 is a schematic diagram of an example tubing anchor.

FIG. 2 is a schematic diagram of an example tubing anchor. Tubing anchor 200 is shown in a partially disassembled view, illustrating many of its component parts in detail in a manner that may not be visible from the assembled view (e.g., shown in FIG. 3).

As illustrated in FIG. 2, tubing anchor 200 includes top sub 202 for connecting to the tubing string or other tools (e.g., via a threaded connection). Top sub 202 is connected to mandrel 206 via a threaded connection. Spring 204 slips over mandrel 206 and is held in place by contact with top sub 202 on one end and contact with upper cone 208 on the other end. Tubing anchor 200 includes an upper cone 208 and a lower cone 216, both of which are positioned inside of gripping assembly housing 210 (which can also be referred to as a slip cage). Gripping assembly housing 210 includes a set of gripping members 212 that are designed to engage the interior wall of wellbore casing when in the set position. Gripping member 212 can include components or features that are configured to create mechanical grip and resist movement along the casing wall when engaged (e.g., pushed into the casing with a perpendicular force). As shown in FIG. 2, gripping member 212 includes an exterior-facing side for producing mechanical grip and an interior-facing side that is sloped such that ends of the gripping member have a thinner profile than the inner portions. When installed in gripping assembly housing 210 with the exterior-facing side protruding through the windows in the slip cage, the interior-facing side is configured to contact the upper and lower cones (208 and 216) when the tubing anchor is in the set state, and the cones are pushed close together. As a result of the complementary sloping profiles of the interior-facing side and the cones, pushing together the upper and lower cones causes the gripping members 212 to be pushed out (e.g., to engage the casing). Tubing anchor 200 includes a set of springs 214 configured to retract the gripping members 212 when they are not in contact with the upper and lower cones. In some instances, references to a "gripping assembly" herein can refer to a combination of one or more of: a griping assembly housing (e.g., 210), one or more gripping members (e.g., 212), and one or more springs (e.g., 214).

As illustrated in FIG. 2, tubing anchor 200 includes a friction assembly housing 218. Friction assembly housing 218 is coupled to the bottom cone 216. Friction assembly housing 218 can include a set of friction members 222 (which can also be referred to as drag blocks). Friction members 222 can be in contact with a set of springs 224 configured to push friction members 222 outward from friction assembly housing 218. Friction members 222 can contact the casing of the wellbore and resist, but not prevent, movement of tubing anchor 200 with respect to the casing. This friction can allow movement of the tubing string (e.g., rotation) for performing the setting action or unsetting action. In some instances, references to a "friction assembly" (or "drag block assembly") herein can refer to a combination of one or more of: a friction assembly housing (e.g., 218), one or more friction members (e.g., 222), and one or more springs (e.g., 224).

As illustrated in FIG. 2, tubing anchor 200 includes a guide body 226 that is coupled to friction assembly housing 218. Guide body 226 includes receptacle track 244 (e.g., a slot) that is configured to allow a lug (e.g., lug 232A of lug ring 232) to travel between a set position and an unset position. For example, receptacle track 244 can include features (e.g., formations or grooves in the track) configured to hold a lug while in a particular position (e.g., set or unset) and a path between such features for the lug to follow when changing positions. Tubing anchor 200 includes a lug ring 232 that is coupled to mandrel 206 via a set of shear screws (234). Set screws 236 couple lock ring 238 to an inner surface of lug ring 232. Mandrel 206 runs along the length of the tool. A setting or unsetting action can include one or more forces applied to the tubing string (e.g., in combination and/or in a particular sequence). For example, the forces can include rotation, tension (e.g., force in the uphole direction), and/or compression (e.g., force in the downhole direction). The setting action can cause lug 232A of lug ring 232 to move along receptacle track 244. For example, the setting action can include applying rotation in a clockwise direction while applying a compressive force to the tool string. The rotation causes the lug to unseat from the unset position and travel down receptacle track 244 in the downhole direction due to the compressive force. The compressive force causes compression of spring 204 and reduction in the distance between top sub 202 and upper cone 208. After lug 232A of lug ring 232 has traveled far enough down receptacle track 244, compression can be released and the lug will settle into a feature of receptacle track 244 that represents the set position. While in the set position, spring 204 remains compressed (relative to the unset position) and provides a force on lug ring 232 that holds lug 232A in the set position (e.g., applies a tension force in the uphole direction that pulls lug 232A into a groove of receptacle track 244).

In some implementations, while in the set state, an unsetting action can cause the tubing anchor 200 to return to the unset state. For example, receptacle track 244 is designed so that applying a clockwise rotational force will cause the lug to travel from the unset position along the track back to the set position (e.g., where the spring 244 decompresses to cause the lug to move longitudinally along the track). This can be referred to as a quarter-turn right-hand unset procedure.

In some implementations, a normal unsetting action (e.g., rotational force) cannot be performed successfully. For example, a normal unsetting action can be attempted and fail to cause the anchor to unset. In cases where rotation cannot be achieved, the tool can be disengaged from the casing wall by applying straight pull tension. In some examples, this predetermined tension level is adjusted prior to deploying the anchor into the wellbore. The applied tension to cause unsetting is designed to shear the lug ring 232 from the mandrel 206. In some examples, if the lug ring 232, equipped with pre-installed shear screws (e.g., 234), shears off the mandrel 206, the lug ring 232 will descend (in the downhole direction) and lock ring 238 will securely fasten onto the mating thread (such as mating surface 302 of FIG. 3) on the mandrel's outer diameter. This action triggers the release of all slips, similar to a normal unsetting procedure (e.g., the quarter-turn right-hand unset procedure described earlier). The lug ring 232 and lock ring 238 combination being secured onto the mandrel enables the tool to descend below the setting depth in the wellbore. This step serves to confirm the release of the tubing anchor and ensures that the applied tension has not caused any damage to the tubing string elsewhere. With the tubing anchor fully released, the tubing string can be retrieved, and the anchor catcher removed from the wellbore.

In some implementations, tubing anchor 200 includes a catch ring 240 that is configured to be a mechanical backstop that catches the lug ring 232 after shearing. In FIG. 2, catch ring 240 is coupled to the end of guide body 226. Tubing anchor 200 also includes a crossover 242 (e.g., for connecting to downhole portions of a tubing string).

Figure 3:
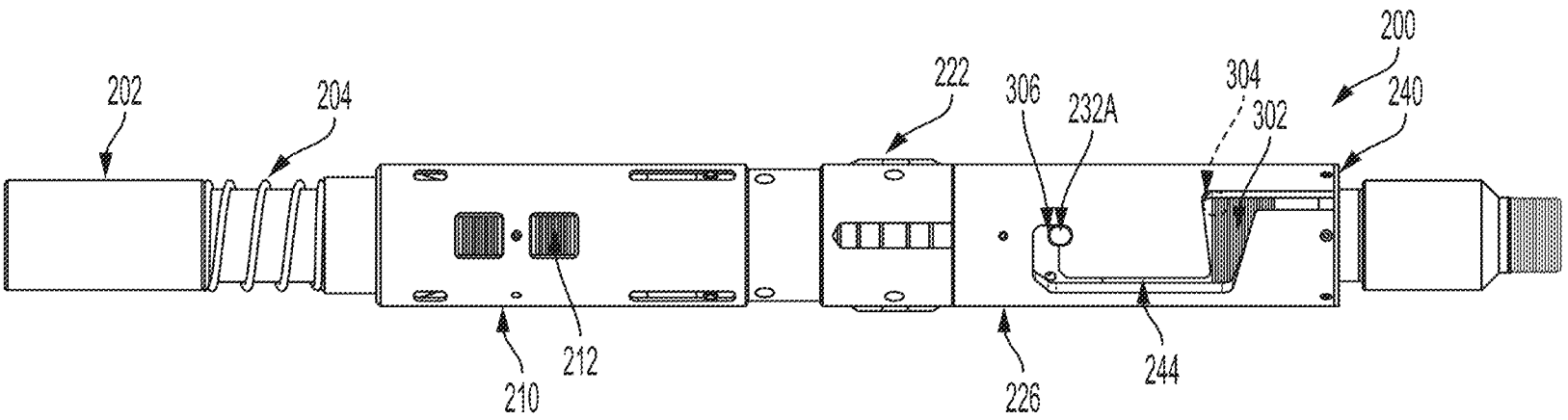
FIG. 3 is a schematic diagram of an example tubing anchor.

FIG. 3 is a schematic diagram of an example tubing anchor. In FIG. 3, tubing anchor 200 is shown in a fully assembled view. In FIG. 3, tubing anchor 200 is in the unset state. For example, lug 232A is in unset position 306 of receptacle track 244. If clockwise rotation and compression is applied to lug ring 232 from uphole via the tubing string (e.g., which causes rotation of top sub 202 and mandrel 206), lug ring 232 will move down receptacle track 244 into a lower region of the track. Once compression is released, lug 232A will settle into set position 304 on receptacle track 244 due to the shape of receptacle track 244 and the upward force of compressed spring 204 as described above. As can be seen from FIG. 3, a further clockwise rotation force would cause lug 232A to travel out of set position 304 and back in the uphole direction along the length of track 244 to the unset position.

FIG. 3 also illustrates mating surface 302. Mating surface 302 includes a set of threads that are machined on the outer surface of mandrel 206. Mating surface 302 is designed and positioned to engage a mating component (e.g., threads) on the inner diameter of lock ring 238 after the lug ring 232 is sheared from the mandrel 206. For example, the threads of the mating components or surfaces can be designed such that they mechanically engage each other. Once mechanically engaged, the mated surfaces can resist movement of the sheared lug ring 232 such that the lug ring is effectively held in place and cannot return to the set position. Mating surface 302 is positioned on mandrel 206 so that it only engages the lock ring 238 of lug ring 232 after the lug ring is sheared (i.e., does not engage during normal operation moving between the set and unset positions). While lug ring 232 is coupled to mandrel 206 (e.g., during normal operation before shearing), the lock ring 238 on the inner surface of lug ring 232 cannot engage with mating surface 302

Figure 4A:
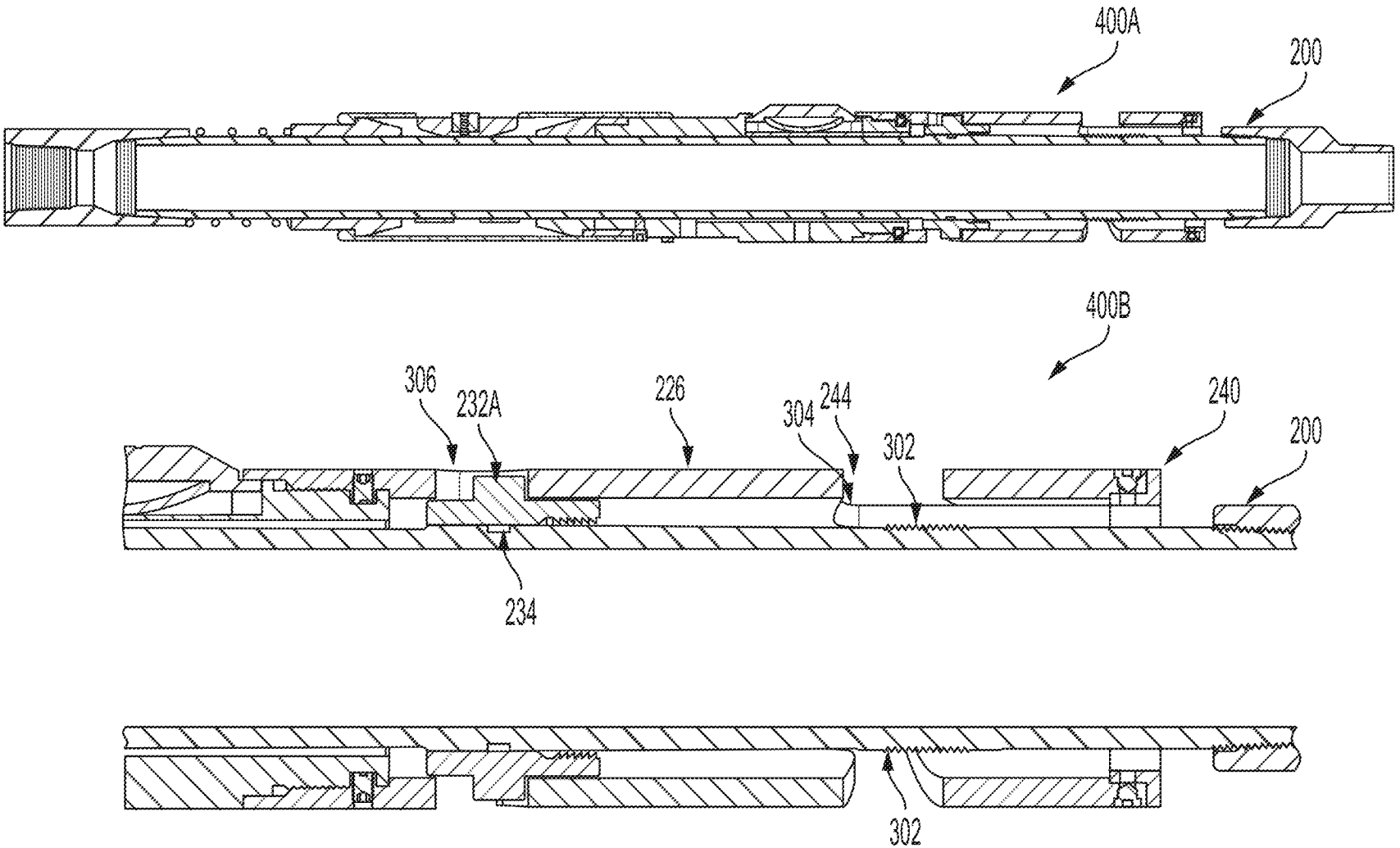
FIG. 4A is a schematic diagram of an example tubing anchor in an unset state.

FIG. 4A is a schematic diagram of an example tubing anchor in an unset state. FIG. 4A includes diagram 400A illustrating a cut away view of tubing anchor 200 while in the unset state. FIG. 4A also includes diagram 400B illustrating a detailed view of the cut away view of tubing anchor 200 while in the unset state. As illustrated in diagram 400B, lug 232A (of lug ring 232) is in unset position 306 of guide body 226 (e.g., is in the same position as shown in FIG. 3). FIG. 4A also illustrates shear screws 234 that are coupling lug ring 232 to mandrel 206. Also visible in FIG. 4A are receptacle track 244, mating surface 302, and catch ring 240. In FIG. 4A, the spring is not compressed in the unset state and the therefore the upper and lower cones are not pushed together to engage the slips.

Figure 4B:
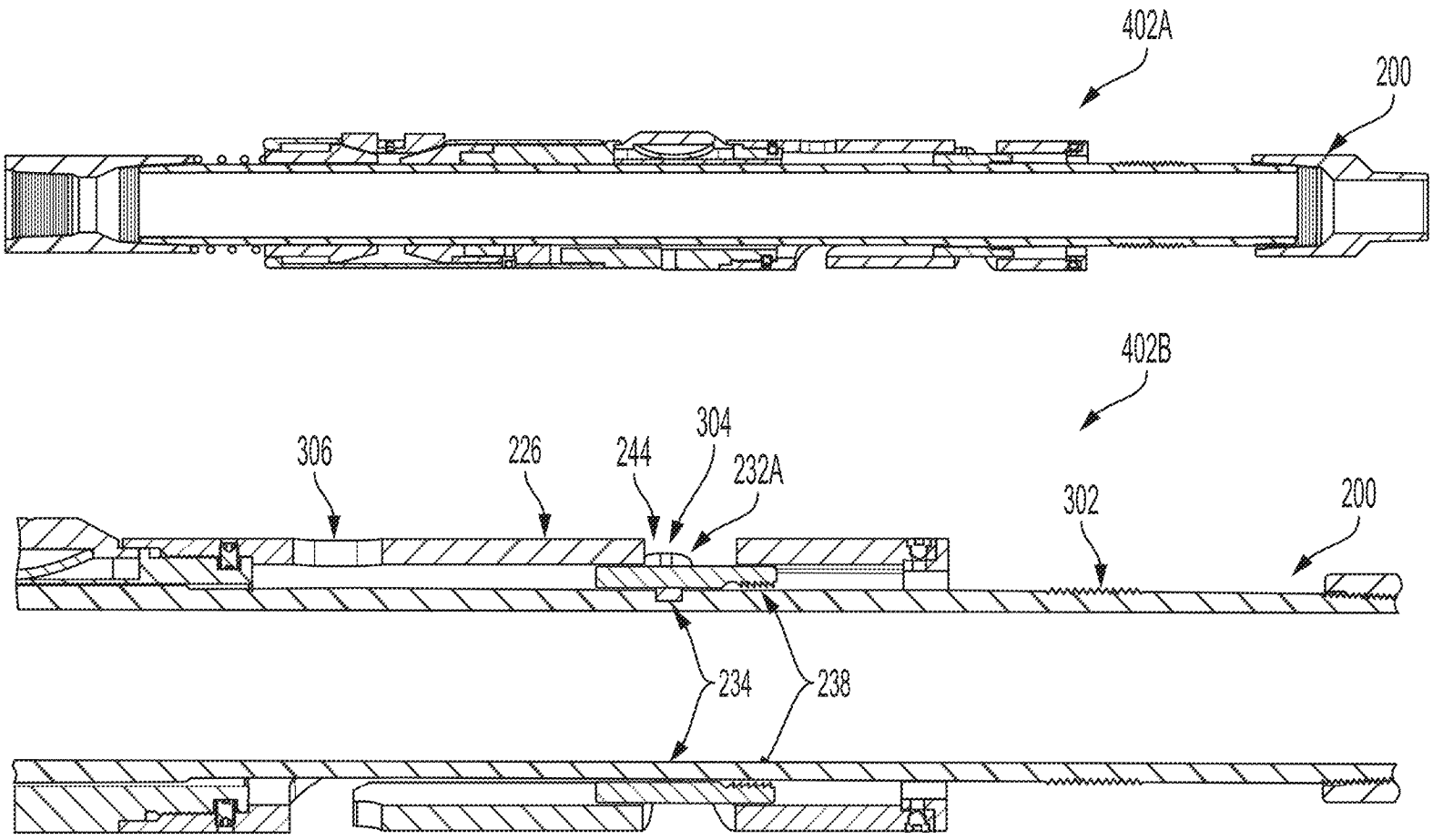
FIG. 4B is a schematic diagram of an example tubing anchor in a set state.

FIG. 4B is a schematic diagram of an example tubing anchor in a set state. FIG. 4B includes diagram 402A illustrating a cut away view of tubing anchor 200 while in the set state. FIG. 4B also includes diagram 402B illustrating a detailed view of the cut away view of tubing anchor 200 while in the set state. As illustrated in diagram 402B, lug 232A (of lug ring 232) is in set position 304 of receptacle track 244 of guide body 226. FIG. 4B also illustrates shear screws 234 that are coupling lug ring 232 to mandrel 206. Also visible in FIG. 4B are receptacle track 244, mating surface 302, and catch ring 240. As shown in FIG. 4B, because lug ring 232 is coupled to mandrel 206, lug ring 232 and mating surface 302 move in tandem—as lug ring 232 has moved along receptacle track 244, mating surface 206 has moved in the same relative manner (e.g., is positioned further downhole than in FIG. 4A). For this reason, lock ring 238 has not engaged with mating surface 302 when moving from the unset position in FIG. 4A to the set position in FIG. 4B. In FIG. 4B, the spring is compressed in the set state and the therefore the upper and lower cones are being pushed together to engage the slips, which are extending outward from tubing anchor 200 (e.g., to engage the casing).

Figure 4C:
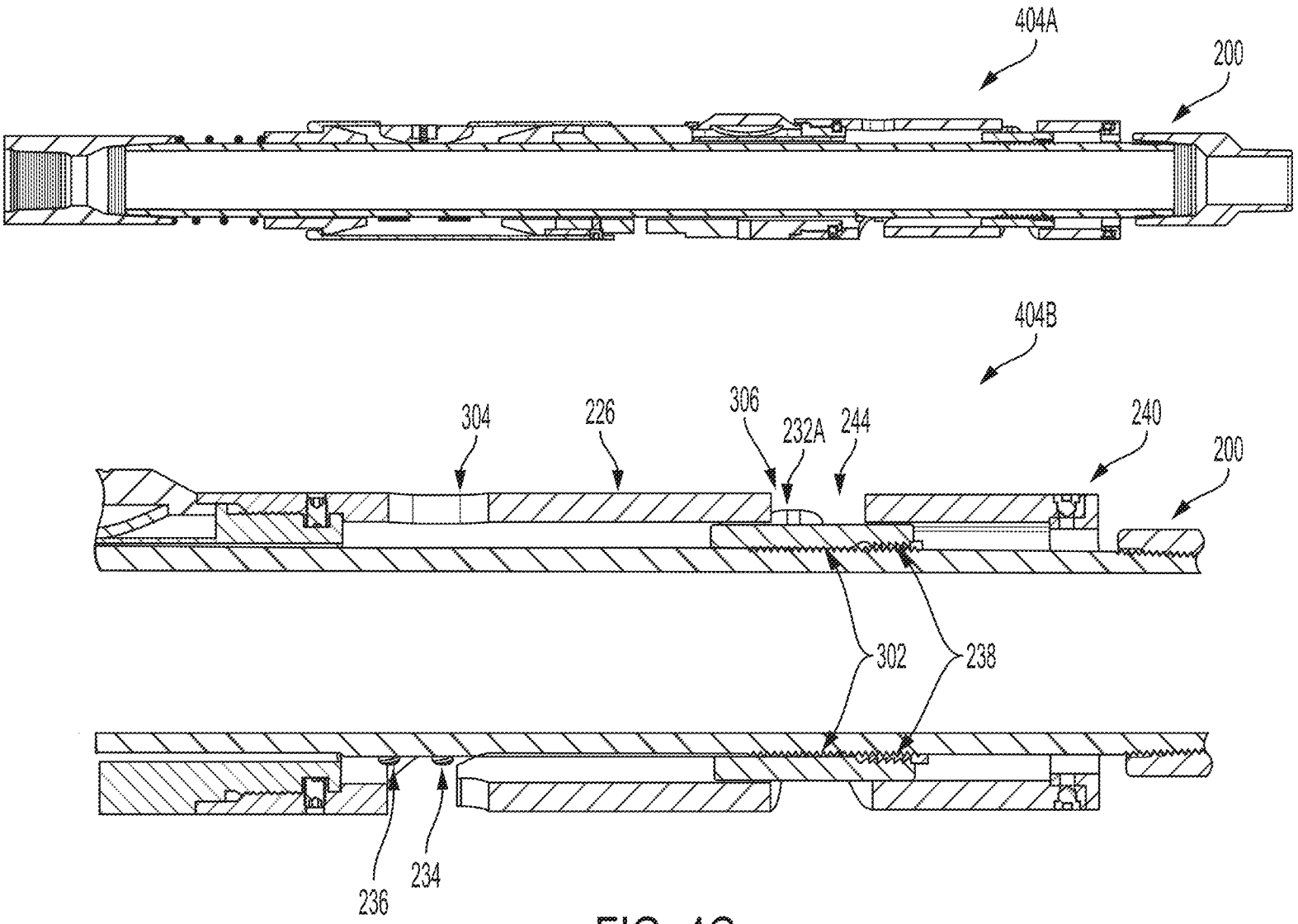
FIG. 4C is a schematic diagram of an example tubing anchor in a sheared state.

FIG. 4C is a schematic diagram of an example tubing anchor in a sheared state. FIG. 4C includes diagram 404A illustrating a cut away view of tubing anchor 200 while in the sheared state. FIG. 4C also includes diagram 404B illustrating a detailed view of the cut away view of tubing anchor 200 while in the sheared state. In FIG. 4C, lug ring 232 has been sheared from being coupled to mandrel 206. For example, while in the set position 304, the tool string was pulled from the surface to apply a tension force sufficient to cause shear screws 234 to shear. In FIG. 4C, sheared portions of screws 234 are shown at the position where lug ring 232 was previously coupled to mandrel 206. After shearing, spring 204 uncompresses and guide body 226 moves down relative to mandrel 206 due to the decompression and the applied tension force. This movement can cause lug ring 232 to be pushed along mandrel 206, causing lock ring 238 to engage with mating surface 302 of mandrel 206. For example, as illustrated in diagram 404B, lug 232A (of lug ring 232) is in set position 304 of receptacle track 244 of guide body 226—as guide body 226 is pushed down due to the applied tension and/or decompression of spring 204, lug ring 232 is pushed down toward mating surface 302. In FIG. 4C, the threaded inner surface of lock ring 238 has engaged with mating surface 302, effectively locking lug ring 232 into a locked position that is configured to prevent the lug ring from moving into the set position when the tool string is moved longitudinally in the wellbore. For example, if an operator pushes the tool string further down hole, the locking of lug ring 232 by contacting catch ring 240 prevents lug 232A from traveling into the set position (e.g., 304), compressing spring 204, and causing the slips to engage the casing wall. For example, when the operator is trying to move the tool in the downhole direction, friction assembly housing 218 and guide body 226 will want to remain stationary; as mandrel 206 is moved downhole, the sheared lug ring 232 (that is latched to the mandrel's mating surface 302 via lock ring 238) contacts catch ring 240, which will force friction assembly housing 218 and guide body 226 to also move downhole.

Examples of a tubing anchor, and the operation thereof, have been described herein. Such examples should not be construed as necessarily limiting the design of a tubing anchor within the scope of this disclosure. For example, a tubing anchor in accordance with this description may include a differently designed receptacle track, guide body, lock ring, mating surface, setting or unsetting action, and/or other feature or component and still be within the intended scope of this disclosure. For example, while threads or grooves may be described as the mode for engaging a lock ring to a mating surface, other mechanical features can be used instead to catch and restrict movement of the lug ring after shearing.

Figure 5:
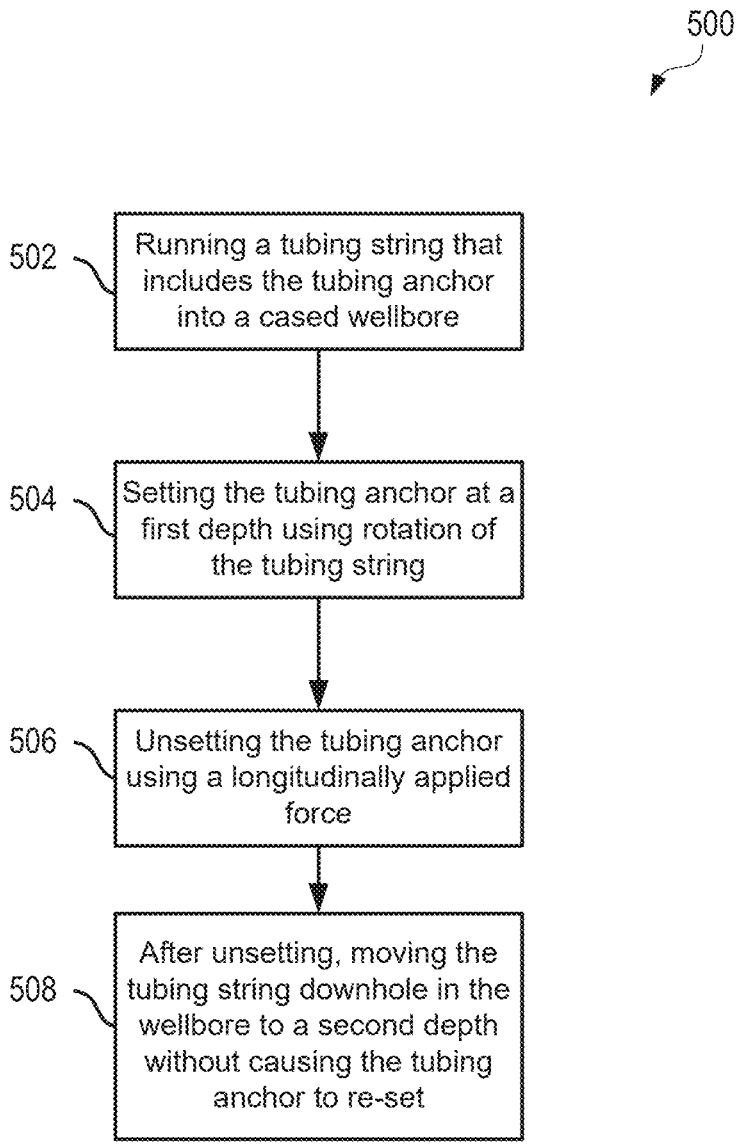
FIG. 5 is a flow chart illustrating an example process for operating a tubing anchor.

FIG. 5 is a flow chart illustrating an example process for operating a tubing anchor. Process 500 can be performed using a tubing anchor, such as tubing anchor 200 as described above. At 502, a tubing string that includes the tubing anchor is run into a cased wellbore. At 504, the tubing anchor is set at a first depth using rotation of the tubing string. In some implementations, a different setting action (e.g., other than rotation) is used to set the tubing anchor at the first depth. At 506, the tubing anchor is unset using a longitudinally applied force. For example, a tension force is applied from the surface that is sufficient to cause a set of shear screws (e.g., 234) to shear. At 508, after unsetting using the longitudinally applied force, the tubing string is moved downhole in the wellbore to a second depth without causing the tubing anchor to re-set (e.g., without returning to the set state). For example, moving the tubing anchor further down hole does not cause the slips to reengage the casing.

In a general aspect, tubing anchor for a cased wellbore is described.

In a first example, a tubing anchor (e.g., tubing anchor 200) for a cased wellbore comprises: a tubular conduit (e.g., mandrel 206) having a mating component (e.g., mating surface 302); a gripping assembly (e.g., gripping assembly housing 210) around the tubular conduit, the gripping assembly comprising a gripping member (e.g., gripping member 212) configured to extend outward from the tubing anchor to engage an inner wall of wellbore casing (e.g., 104); a first tapered member (e.g., upper cone 208) around the tubular conduit; a second tapered member (e.g., lower cone 216) around the tubular conduit; a compression spring (e.g., spring 204) around the tubular conduit, the compression spring configured to, when compressed, move the first tapered member toward the second tapered member to cause the gripping member to extend outward; a friction assembly (e.g., friction assembly housing 218) around the tubular conduit, the friction assembly comprising a friction member (e.g., friction member 222) configured to engage the inner wall of the wellbore casing; a guide body around the tubular conduit, the guide body (e.g., 226) comprising a receptacle track (e.g., 244); a lug ring (e.g., 232) around the tubular conduit, the lug ring configured to rotate with rotation of the tubular conduit, and the lug ring comprising an outward protruding lug (e.g., 232A) that is configured to move within the receptacle track of the guide body between a set position (e.g., 304) of the receptacle track and an unset position (e.g., 306) of the receptacle track; and a lock member (e.g., lock ring 238) around the tubular conduit, the lock member connected to the lug ring, and the lock member configured to engage the mating component of the tubular conduit to prevent the lug ring from returning to the set position when the lug ring has been sheared from the tubular conduit.

Implementations of the first example may include one or more of the following features. A set of shear members (e.g., shear screws 234) configured to couple the lug ring to the tubular conduit, wherein the set of shear members is configured to shear in response to an applied shear force (e.g., straight pull tension or emergency release). The lock member comprises inward protruding raised grooves facing the tubular conduit; and the mating component of the tubular conduit comprises outward protruding raised grooves (e.g., threads) configured to engage the inward protruding raised grooves (e.g., threads) of the lock member when the lug ring has been sheared from the tubular conduit. The mating component is configured to be in a position that is farther downhole than the lug ring while the tubing anchor is installed in a cased wellbore and while the lug ring is in the set position; and the mating component is configured to be in a position that is farther downhole than the lug ring while the tubing anchor is installed in a cased wellbore and while the lug ring is in the unset position. A catch member (e.g., catch ring 240) configured to catch the lug ring when the tubing anchor is installed in a cased wellbore and the lug ring has been sheared from the tubular conduit. The catch member is coupled to the guide body by set screws. The gripping assembly comprises a spring member configured to hold the gripping member in a non-engaged position (e.g., an unset position, a position inside of the gripping assembly, a position in contact with the tubular conduit, or a position not in contact with the inner wall of the wellbore casing) until movement of the first tapered member toward the second tapered member causes the gripping member to extend outward from the tubing anchor to engage the inner wall of the wellbore casing. The friction assembly comprises a spring member configured to force the friction member to extend outward from the tubing anchor to engage the inner wall of the wellbore casing. The gripping assembly comprises a portion (e.g., a lip, a collar, or a ring) having a reduced internal diameter that is configured to limit movement of the first tapered member away from the second tapered member. The second tapered member is coupled to the friction assembly. The friction assembly is coupled to the guide body. The gripping member of the gripping assembly and the friction member of the friction assembly are aligned along a longitudinal axis of the tubing anchor in a manner configured to assist migration of gas between the tubing anchor and wellbore casing.

In a second example, a method of operating a tubing anchor for a cased wellbore includes: running a tubing string into the cased wellbore, wherein the tubing string comprises the tubing anchor; at a first depth in the cased wellbore, setting the tubing anchor by applying rotation of the tubing string uphole from the tubing anchor, wherein setting the tubing anchor comprises: causing a friction assembly to engage casing of the cased wellbore to resist rotation of the tubing string downhole of the friction assembly; causing a lug ring of the tubing anchor to move within a receptacle track of a guide body from an unset position to a set position; and causing a gripping assembly of the tubing anchor to extend a gripping member of the tubing anchor to engage the casing of the cased wellbore when in the set position; unsetting the tubing anchor by applying a longitudinal unsetting force to the tubing string, wherein unsetting the tubing anchor comprises: causing the lug ring to move to a locked position that is different from the set position and different from the unset position; after unsetting the tubing anchor by applying the longitudinal unsetting force, and while the tubing string remains in the cased wellbore, lowering the tubing string to a second depth in the cased wellbore that is farther downhole than the first depth.

Implementations of the second example may include one or more of the following features. While lowering the tubing string to the second depth in the cased wellbore that is farther downhole than the first depth: the lug ring remains in the locked position that is different from the set position and different from the unset position; and the gripping member remains unengaged from the casing of the cased wellbore. The longitudinal unsetting force is a tension force. Setting the tubing anchor comprises moving the tubing string to apply a setting force to cause compression of a compression spring of the tubing anchor. The compression of the compression spring causes the gripping member to extend to engage the casing of the cased wellbore. After unsetting the tubing anchor by applying the longitudinal unsetting force: the compression spring ceases to be compressed; and the lowering of the tubing string to the second depth does not cause the compression of the compression spring or cause the gripping member to extend to engage the casing of the cased wellbore.

In a third example, a tubing anchor for a cased wellbore comprises: a tubular conduit; means for gripping an inner wall of wellbore casing of the cased wellbore; means for receiving rotational force for setting the tubing anchor, wherein setting the tubing anchor includes causing the means for gripping to engage the inner wall of the wellbore casing to resist longitudinal movement of the tubing anchor; means for unsetting the tubing anchor using a longitudinally applied unsetting force; and means for, after unsetting the tubing anchor using the longitudinally applied unsetting force, preventing the means for gripping from engaging the inner wall of the wellbore casing in response to movement of the tubing anchor in a downhole direction.

While this specification contains many details, these should not be understood as limitations on the scope of what may be claimed, but rather as descriptions of features specific to particular examples. Certain features that are described in this specification or shown in the drawings in the context of separate implementations can also be combined. Conversely, various features that are described or shown in the context of a single implementation can also be implemented in multiple embodiments separately or in any suitable sub-combination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described above should not be understood as requiring such separation in all implementations, and it should be understood that the described program components and systems can generally be integrated together in a single product or packaged into multiple products.

A number of embodiments have been described. Nevertheless, it will be understood that various modifications can be made. Accordingly, other embodiments are within the scope of the following claims.

What is claimed is:

1. A tubing anchor for a cased wellbore, the tubing anchor comprising:

a tubular conduit having a mating component;

a gripping assembly around the tubular conduit, the gripping assembly comprising a gripping member configured to extend outward from the tubing anchor to engage an inner wall of wellbore casing;

a first tapered member around the tubular conduit;

a second tapered member around the tubular conduit;

a compression spring around the tubular conduit, the compression spring configured to, when compressed, move the first tapered member toward the second tapered member to cause the gripping member to extend outward;

a friction assembly around the tubular conduit, the friction assembly comprising a friction member configured to engage the inner wall of the wellbore casing;

a guide body around the tubular conduit, the guide body comprising a receptacle track;

a lug ring around the tubular conduit, the lug ring configured to rotate with rotation of the tubular conduit, and the lug ring comprising an outward protruding lug that is configured to move within the receptacle track of the guide body between a set position of the receptacle track and an unset position of the receptacle track; and a lock member around the tubular conduit, the lock member being connected to the lug ring and configured to engage the mating component of the tubular conduit to prevent the lug ring from returning to the set position when the lug ring has been sheared from the tubular conduit.

2. The tubing anchor of claim 1, comprising a set of shear members configured to couple the lug ring to the tubular conduit, wherein the set of shear members is configured to shear in response to an applied shear force.

3. The tubing anchor of claim 1, wherein the lock member comprises inward protruding raised grooves facing the tubular conduit; and wherein the mating component of the tubular conduit comprises outward protruding raised grooves configured to engage the inward protruding raised grooves of the lock member when the lug ring has been sheared from the tubular conduit.

4. The tubing anchor of claim 1, wherein, the mating component is configured to be in a position that is farther downhole than the lug ring while the tubing anchor is installed in a cased wellbore and while the lug ring is in the set position; and the mating component is configured to be in a position that is farther downhole than the lug ring while the tubing anchor is installed in a cased wellbore and while the lug ring is in the unset position.

5. The tubing anchor of claim 1, comprising a catch member configured to catch the lug ring when the tubing anchor is installed in a cased wellbore and the lug ring has been sheared from the tubular conduit.

6. The tubing anchor of claim 5, wherein the catch member is coupled to the guide body by set screws.

7. The tubing anchor of claim 1, wherein the gripping assembly comprises a spring member configured to hold the gripping member in a non-engaged position until movement of the first tapered member toward the second tapered member causes the gripping member to extend outward from the tubing anchor to engage the inner wall of the wellbore casing.

8. The tubing anchor of claim 1, wherein the friction assembly comprises a spring member configured to force the friction member to extend outward from the tubing anchor to engage the inner wall of the wellbore casing.

9. The tubing anchor of claim 1, wherein the gripping assembly comprises a portion having a reduced internal diameter that is configured to limit movement of the first tapered member away from the second tapered member.

10. The tubing anchor of claim 1, wherein the second tapered member is coupled to the friction assembly.

11. The tubing anchor of claim 1, wherein the friction assembly is coupled to the guide body.

12. The tubing anchor of claim 1, wherein the gripping member of the gripping assembly and the friction member of the friction assembly are aligned along a longitudinal axis of the tubing anchor in a manner configured to assist migration of gas between the tubing anchor and wellbore casing.

13. A method of operating a tubing anchor for a cased wellbore, the method comprising:

running a tubing string into the cased wellbore, wherein the tubing string comprises the tubing anchor;

at a first depth in the cased wellbore, setting the tubing anchor by applying rotation of the tubing string uphole from the tubing anchor, wherein setting the tubing anchor comprises:

causing a friction assembly to engage casing of the cased wellbore to resist rotation of the tubing string downhole of the friction assembly;

causing a lug ring of the tubing anchor to move within a receptacle track of a guide body from an unset position to a set position; and causing a gripping assembly of the tubing anchor to extend a gripping member of the tubing anchor to engage the casing of the cased wellbore when in the set position;

unsetting the tubing anchor by applying a longitudinal unsetting force to the tubing string, wherein unsetting the tubing anchor comprises:

causing the lug ring to move to a locked position that is different from the set position and different from the unset position;

after unsetting the tubing anchor by applying the longitudinal unsetting force, and while the tubing string remains in the cased wellbore, lowering the tubing string to a second depth in the cased wellbore that is farther downhole than the first depth.

14. The method of claim 13, wherein while lowering the tubing string to the second depth in the cased wellbore that is farther downhole than the first depth:

the lug ring remains in the locked position that is different from the set position and different from the unset position; and the gripping member remains unengaged from the casing of the cased wellbore.

15. The method of claim 13, wherein the longitudinal unsetting force is a tension force.

16. The method of claim 13, wherein setting the tubing anchor comprises moving the tubing string to apply a setting force to cause compression of a compression spring of the tubing anchor.

17. The method of claim 16, wherein the compression of the compression spring causes the gripping member to extend to engage the casing of the cased wellbore.

18. The method of claim 17, wherein after unsetting the tubing anchor by applying the longitudinal unsetting force:

the compression spring ceases to be compressed; and the lowering of the tubing string to the second depth does not cause the compression of the compression spring or cause the gripping member to extend to engage the casing of the cased wellbore.

* * * * *